US011058185B2

(12) United States Patent
Mojica

(10) Patent No.: US 11,058,185 B2
(45) **Date of Patent: *Jul. 13, 2021**

(54) SLIDE RELEASE BUCKLE WITH INCENDIARY IMPLEMENTS

(71) Applicant: Outdoor Element, LLC, Englewood, CO (US)

(72) Inventor: Michael John Mojica, Englewood, CO (US)

(73) Assignee: Outdoor Element LLC, Englewood, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/705,986

(22) Filed: Dec. 6, 2019

(65) Prior Publication Data

US 2020/0128922 A1 Apr. 30, 2020

Related U.S. Application Data

(63) Continuation of application No. 14/568,022, filed on Dec. 11, 2014, now Pat. No. 10,694,818.

(60) Provisional application No. 61/932,764, filed on Jan. 28, 2014.

(51) Int. Cl.

| | |
|---|---|
| ***A44B 11/00*** | (2006.01) |
| ***A45F 3/00*** | (2006.01) |
| ***A44B 11/25*** | (2006.01) |

(52) U.S. Cl.

CPC ..... *A44B 11/005* (2013.01); *A44B 11/2592* (2013.01); *A45F 3/00* (2013.01); *A45F 2003/001* (2013.01)

(58) Field of Classification Search

CPC ..... A44B 11/005; A44B 11/2592; A45F 3/00; A45F 2003/001; F23Q 1/06; F23Q 1/00; F23Q 1/01

See application file for complete search history.

(56) References Cited

U.S. PATENT DOCUMENTS

2013/0189631 A1 7/2013 Mojica

FOREIGN PATENT DOCUMENTS

GB 278332 A 12/1927

*Primary Examiner* — Jack W Lavinder
(74) *Attorney, Agent, or Firm* — Holland and Hart LLP

(57) ABSTRACT

The invention relates to a novel incendiary device with a fire starter and a quick release slide buckle wherein sparking and ignition means reside in the buckle apparatus, and which buckle may be attached to clothing, backpacks or any other item a quick release slide buckle may be utilized. One portion of the buckle houses a sparking and combustible material, and the other is a mating side of a quick release buckle. Adding a fire starter to a quick release buckle is a novel tool for any outdoor activity that requires fire ignition.

16 Claims, 6 Drawing Sheets

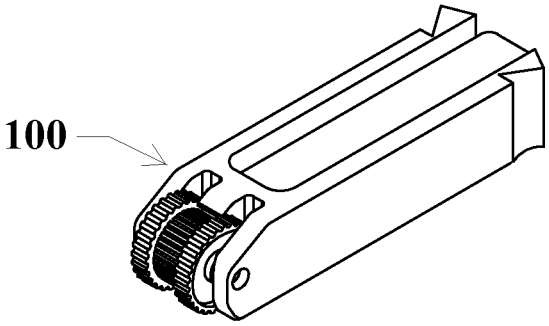
FIG. 6
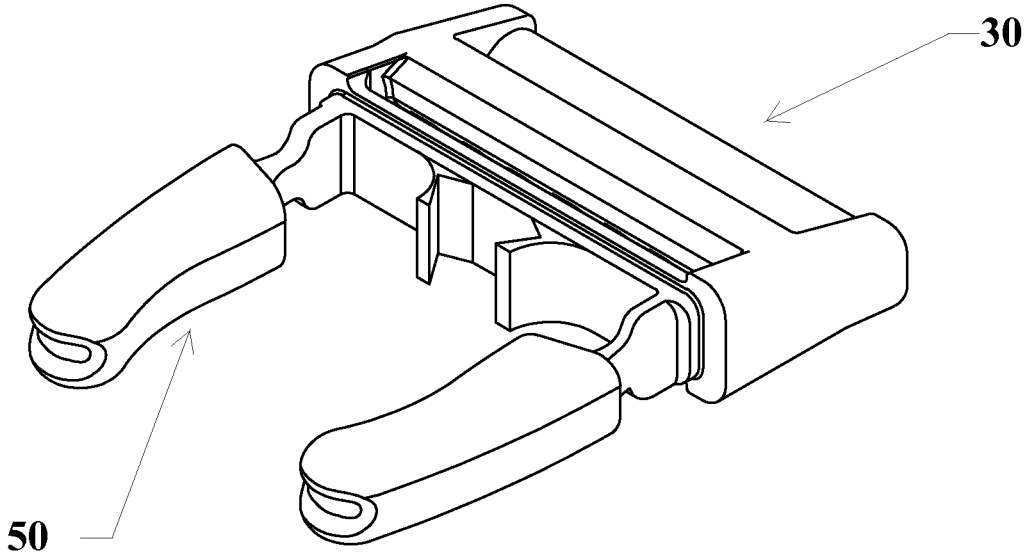
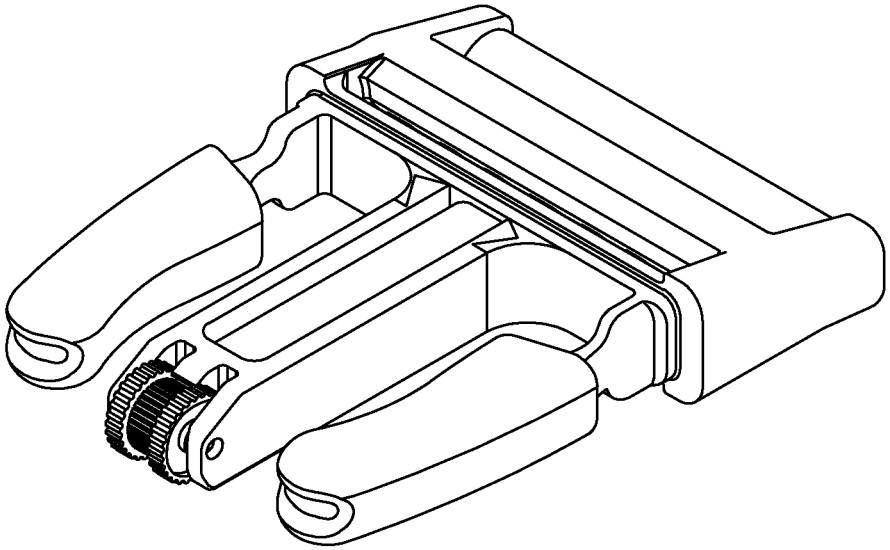

SLIDE RELEASE BUCKLE WITH INCENDIARY IMPLEMENTS

CROSS REFERENCES TO RELATED APPLICATIONS

This application is a continuation application of U.S. patent application Ser. No. 14/568,022, filed Dec. 11, 2014, which claims benefit to U.S. Provisional Patent Application No. 61/932,764 filed Jan. 28, 2014, the contents of which are hereby incorporated by reference in their entirety.

FIELD

The invention relates to a novel incendiary device with a fire starter and a quick release slide buckle wherein sparking and ignition means reside in the buckle apparatus and which buckle may be attached to clothing, backpacks or any other item a quick release slide buckle may be utilized.

BACKGROUND OF THE INVENTION

The invention most closely corresponds with USPTO Class 416/254 wherein Class 416 relates to for setting fire or to cause a heat source to burn and sub-class 254 includes electrical and mechanical igniters.

In its simplest form, the invention relates to a novel buckle apparatus with a fire starter and a quick release slide buckle wherein sparking and ignition means reside in the buckle itself, and which buckle may be attached to clothing, backpacks or any other item a quick release slide buckle may be utilized. A sparking or combustible material is assembled with a spring and friction spark wheel housed within one side of the quick release buckle. The sparking material may be made of ferrocerium, flint or other sparking elements. The friction portion in the form of a spark wheel is located on the same side of the buckle and may be made of high carbon steel or other material that will generate sparks or combustion when rubbed with the combustible or sparking portion. The spark wheel is rotated by a user. The spark wheel is aligned so that it is contact with the flint (ferrocerium). When the spark wheel is rotated, sparks are generated by the flint and projected at the end of the buckle to an item intended to be ignited. In operation, a user will typically rotate the spark wheel with a thumb or finger. The intended method of operation is similar to that of a hand held lighter.

Building a fire is the most important task when dealing with survival in the wilderness. However, most people who find themselves in survival situations do so unexpectedly. As a result, they are not typically carrying conventional fire starting materials.

THE INVENTION

Summary, Objects and Advantages

The use of small incendiary devices is known in prior art. For example, one type of known fire starting tool is a magnesium block with a sparking insert attached to one side. However, the user must also have a knife in order to scrape off magnesium shavings. The knife may also be used to scrape the sparking insert rapidly in order to produce sufficient sparks to ignite the magnesium shavings. Although such magnesium blocks with sparking inserts may come equipped with a beaded chain to link to a keychain, they are not typically carried on a daily basis by users.

Another type of known incendiary device has a separate striker and starter linked together by a lanyard. Although the inclusion of a striker eliminates the need for a knife, the separate fire starting elements make this fire starting tool bulkier than the magnesium block with a sparking insert. Even though it is a lanyard meant to be worn around the neck, this type of fire starting tool is still not commonly or conveniently carried on a daily basis by users.

A further type of incendiary device has been developed as a quick release buckle with fire starting components (Ser. No. 13/747,385). This buckle requires both sides of the buckle to house separate parts of the fire or sparking elements. This design requires the user to develop a skill set for striking the two portions together to generate the spark for fire creation. This method has proven difficult for many people and requires training for proper use of this invention. It also requires a significant amount of force to generate the sparks. Some individuals cannot provide adequate force for the spark generation.

Therefore, the need exists for a new and improved device that will both prepare one for survival modes such as starting fires, and provide common fastening needs for gear or clothing worn or used by one in an outdoor setting which are simple and intuitive to use. The current invention provides an internal force that will be sufficient for spark generation without requiring an undue amount of force application by a user. Adding fire starting components to a single side of a quick release buckle provides a variety of embodiments that an individual would utilize on an everyday basis while giving the individual the ability to create fires when needed. For example, quick release buckles are utilized in many applications such as back packs, rock climbing gear, lap top bags, purses, zipper pulls, tents, helmets, and many other areas. In this respect, the single sided quick release buckle with integrated fire starting components according to the present invention substantially departs from the conventional concepts and designs of the prior art, and in doing so provides an apparatus primarily developed for enabling fire starting while still providing the utility of a buckle with its many uses. The present invention is not limited to application on a belt, but may be affixed to the aforementioned variety of items, and in a variety of configurations.

BRIEF DESCRIPTION OF THE DRAWINGS

The invention is described in further detail by reference to six (6) drawings sufficient in detail to describe the invention in which:

FIG. 6 is an illustration of the center male piece containing the spark and flint means wherein the spark means are detachable.

DETAILED DESCRIPTION, INCLUDING BEST MODES OF CARRYING OUT THE INVENTION

Figure 1:
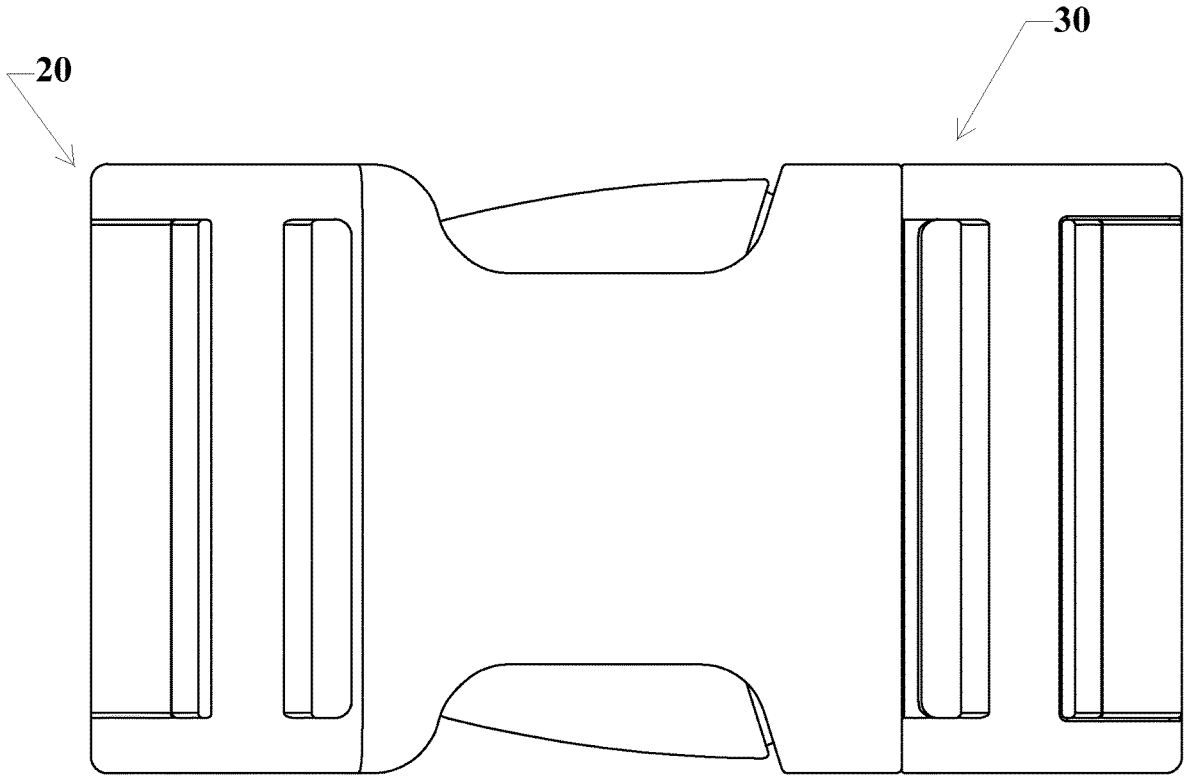
FIG. 1 is a top view of current embodiment of the slide release buckle with integrated fire starting components. The assembly has features for webbing which are typical for buckle application in accordance with the principles of the present invention.

FIG. 1 illustrates an improved construction of a quick release buckle with single sided fire starting components as part of a greater assembly. The female portion of the buckle 20 slides over the male portion 30. In this illustration, when the buckle assembly is fully seated, the sparking or combustible material is concealed by the female portion 20. This illustrates a preferred embodiment, but the buckle form can include obvious variations which may be germane to buckles purposed for affixing two ends or sides of an item together.

Figure 2:
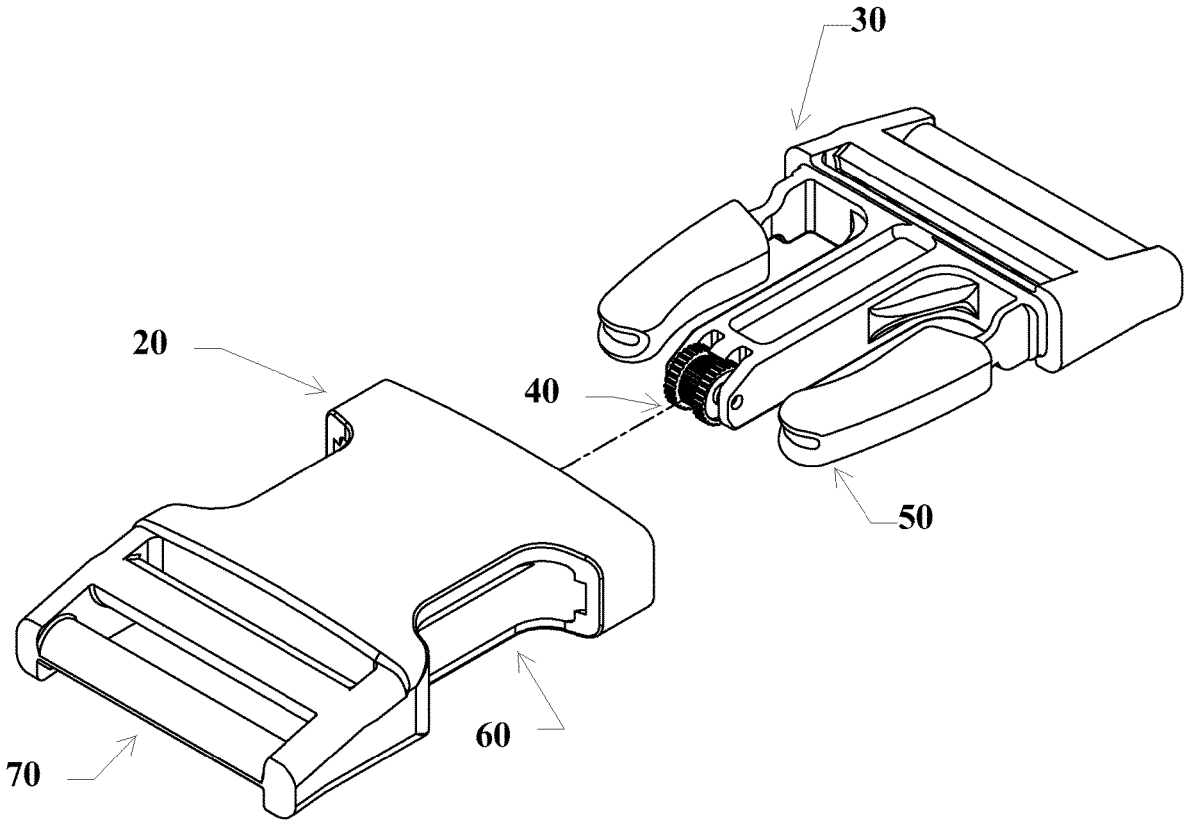
FIG. 2 is a top perspective view of the complete quick release buckle assembly, both female and male portions.

FIG. 2 illustrates an exploded assembly of the improved construction of a single sided quick release buckle with fire starting components. The sparking wheel 40 is housed at the end of the male connector portion 30 centered between two snap support pieces 50. The female portion 20 is shown with release tabs 60 and affixing points 70.

Figure 3:
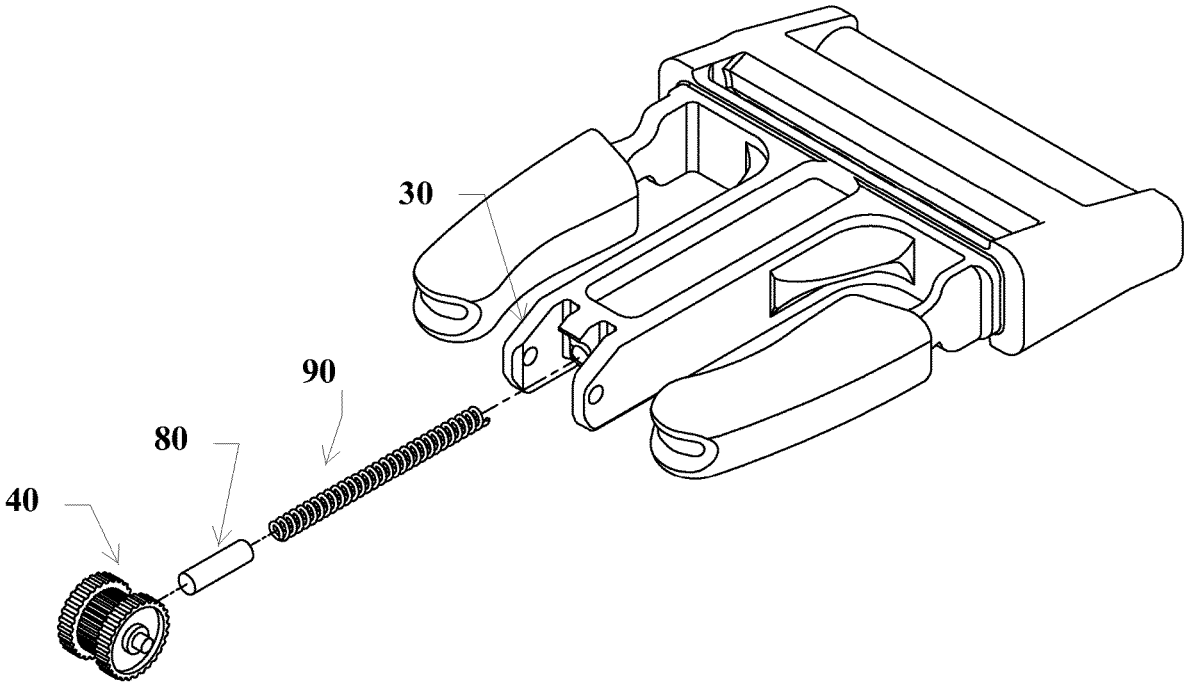
FIG. 3 is an exploded perspective top side view of the male side of the quick release buckle with integrated fire starter components, namely spark wheel, ferrocerium rod, and spring.

FIG. 3 illustrates an exploded assembly of the improved fire starting quick release buckle. The spark wheel 40 is attached to the male portion center 30 and makes contact with the ferrocerium rod 80. A spring 90 connects to the male portion center 30 and to the rod and wheel wherein the spring provides sufficient force for the ferrocerium rod and spark wheel to create spark when the spark wheel is turned with adequate speed.

Figure 4:
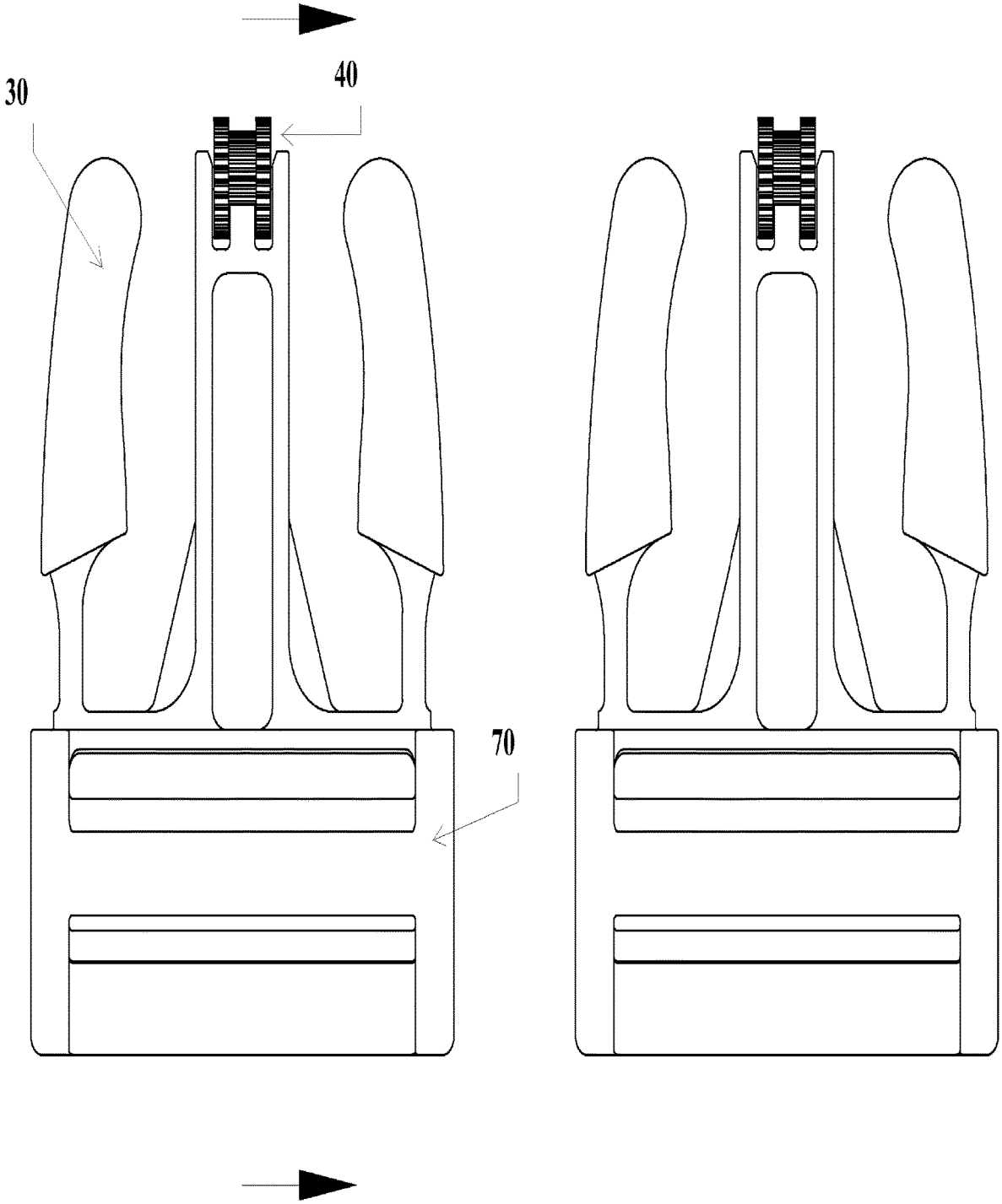
FIG. 4 is a top side view of the male portion of the buckle with sparking assembly.

FIG. 4 is a simple top view of the male portion 30 of the buckle with the spark wheel 40 and affixing point 70.

Figure 5:
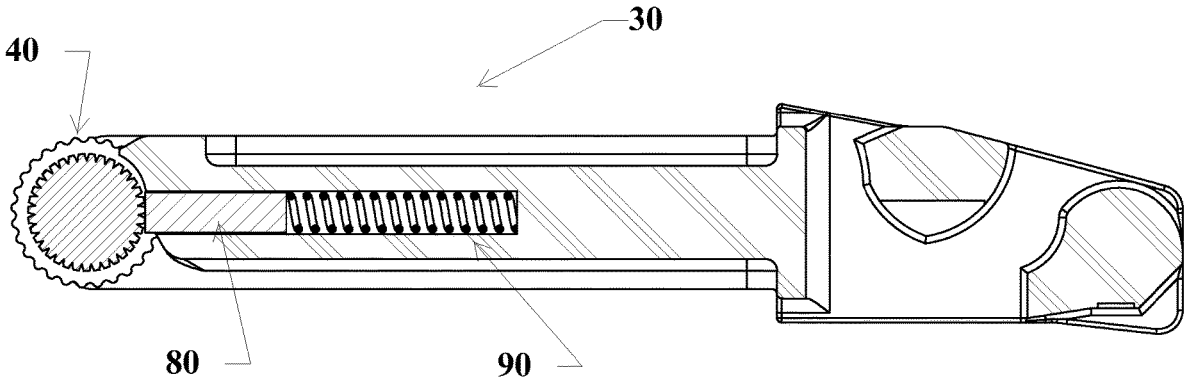
FIG. 5 is an orthographic section view of FIG. 4 showing the internal assembly of the sparking generating components and side view of the male portion of the buckle.

FIG. 5 is a section view in a third angle orthographic projection showing the male end of the buckle 30 with the sparking wheel 40 connected to the ferrocerium rod 80 and spring 90. In this form the incendiary capabilities of the buckle are enabled.

FIG. 6 is an illustration of the center male piece 30 wherein the spark and flint portion 100 is detachable so a user may remove and replace the spark and flint portion. The spark and flint portion is simply snapped into the male center of the buckle between the two snap support portions 50.

Another embodiment can provide for a small tank of butane or other flammable matter situated in one side of the buckle to assist in the spark wheel and flint method so as to provide just enough fuel for flame while not impeding the buckle connection or making the buckle so oversized as to be cumbersome. While current embodiments of the quick release buckle with single sided fire starting components have been disclosed herein in reasonable detail, it should be noted that minor modifications and variations thereto do not obviate the present invention.

The invention claimed is:

1. A method for creating a spark, the method comprising:

providing a quick release slide buckle having a sparking and ignition device housed only within a first side of the quick release slide buckle, rotating a spark wheel of the sparking and ignition device about an axis; and creating a spark, wherein the axis is parallel to an axis extending along a width of the first side of the quick release slide buckle.

2. The method of claim 1, further comprising:

biasing a ferrocerium rod against the spark wheel with a spring such that the spring provides sufficient force for the ferrocerium rod and the spark wheel to create the spark when the spark wheel is rotated.

3. The method of claim 1, further comprising projecting the spark to an item to be ignited.

4. The method of claim 1, further comprising rotating the spark wheel with a thumb or finger.

5. The method of claim 1, further comprising attaching the quick release slide buckle to clothing or equipment.

6. The method of claim 1, wherein the sparking and ignition device provides an internal force configured to generate the spark when the spark wheel is rotated.

7. The method of claim 1, further comprising seating the first side of the quick release slide buckle in a second side of the quick release slide buckle to conceal the sparking and ignition device in the quick release slide buckle.

8. The method of claim 1, wherein the sparking and ignition device comprise the spark wheel, a sparking element, and a spring.

9. The method of claim 1, wherein the first side is a male portion having a male portion center, the sparking and ignition device housed within the male portion center.

10. The method of claim 9, wherein the male portion further comprises two snap support pieces, wherein the male portion center and sparking and ignition device are centered between the two snap support pieces.

11. The method of claim 9, wherein a diameter of the spark wheel is the same as a height of the male portion center and less than the height of the male portion.

12. A buckle comprising:

a first side of the buckle configured to releasably couple to a second side of the buckle; and a sparking and ignition device having a spark wheel with a rotation axis, wherein the sparking and ignition device is housed only with the first side of the buckle, and wherein the rotation axis is parallel to an axis extending along a width of the first side of the buckle.

13. The buckle of claim 12, the sparking and ignition device further comprising a ferrocerium rod biased against the spark wheel, the ferrocerium rod housed within a cavity of the first side.

14. The buckle of claim 12, wherein the sparking and ignition device is configured to be concealed when the first side is coupled to the second side.

15. The buckle of claim 12, wherein the first side is a male portion having a male portion center, the sparking and ignition device housed within a cavity of the male portion center, and wherein the male portion center and sparking and ignition device are centered between two snap support pieces.

16. The buckle of claim 15, wherein a diameter of the spark wheel is the same as a height of the male portion center and less than the height of the male portion.

* * * * *